US005164777A

United States Patent [19]

Agarwal et al.

[11] Patent Number: 5,164,777

[45] Date of Patent: Nov. 17, 1992

[54] BELT SUPPORT AND TRACKING APPARATUS

[75] Inventors: Vinod K. Agarwal; Stephen A. Bonelli, both of Webster, N.Y.

[73] Assignee: Xerox Corporation, Stamford, Conn.

[21] Appl. No.: 708,336

[22] Filed: May 31, 1991

[51] Int. Cl.[5] ..... G03G 5/00; G03G 15/00

[52] U.S. Cl. ..... 355/212; 198/841; 198/814; 474/117

[58] Field of Search ..... 355/200, 212; 198/833, 198/841, 814; 474/117, 138

[56] References Cited

U.S. PATENT DOCUMENTS

| | | | |
|---|---|---|---|
| 1,615,544 | 1/1927 | Hutchison | 474/117 X |
| 4,121,226 | 10/1978 | Alden | 474/138 X |
| 4,198,155 | 4/1980 | Silverberg | 355/212 |
| 4,206,994 | 6/1980 | Silverberg et al. | 355/212 |
| 4,657,370 | 4/1987 | Forbes et al. | 355/212 |
| 4,924,272 | 5/1990 | Hediger et al. | 355/212 X |
| 5,073,801 | 12/1999 | Haneda et al. | 355/311 |

FOREIGN PATENT DOCUMENTS

| | | | |
|---|---|---|---|
| 3234723 | 3/1984 | Fed. Rep. of Germany | 198/833 |
| 630141 | 10/1978 | U.S.S.R. . | |
| 1119713 | 12/1985 | U.S.S.R. | 198/833 |

*Primary Examiner*—Joan H. Pendergrass
*Assistant Examiner*—Robert Beatty

[57] ABSTRACT

An apparatus for transporting and tracking a belt arranged to move in a predetermined path and controlling lateral movement of the belt from the predetermined path includes a stationary non-rotating arcuate tracking shoe with a belt defining surface for supporting a belt including vertically oriented flanges at each side of said path defining surface and extending from said path defining surface outwardly to provide belt edge guides. An unconstrained slip belt is positioned between the tracking shoe and the belt. When driving the belt around the tracking shoe the velocity of the belt in the axial direction of the tracking shoe is zero when the belt touches an edge guide. Therefore, the friction force acting on the belt from the tracking shoe in the axial direction approaches zero, which helps to keep the total system force applied at the edge guide less than the minimum force necessary to produce buckling of the side of the belt. The slip belt reduces the drive torque necessary for driving the belt and eliminates wear of an anti-curl back coating on the belt.

11 Claims, 4 Drawing Sheets

BELT SUPPORT AND TRACKING APPARATUS

BACKGROUND OF THE INVENTION

The present invention relates to a belt supporting and tracking apparatus, and more particularly to an apparatus for controlling the lateral movement of a belt from its predetermined path while reducing wear of the inside surface of the belt as well as reducing torque required to drive the belt.

In an electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

Many commercial applications of the above process employ the use of the photoconductive insulating member in the form of a belt which is supported about a predetermined path past the plurality of processing stations to ultimately form a reproduced image on copy paper. The location of the latent image recorded on the photoconductive belt must be precisely defined in order to have the various processing stations acting thereon optimize copy quality. To this end it is critical that the lateral alignment of the photoconductive belt be controlled within prescribed tolerances. Only in this manner will a photoconductive belt move through a predetermined path so that the processing stations disposed thereabout will be located precisely relative to the latent image recorded thereon.

PRIOR ART

When considering control of the lateral movement of the belt, it is well known that if the belt were perfectly constructed and entrained about perfect cylindrical rollers mounted and secured in an exactly parallel relationship with one another, there would be no lateral movement of the belt. In actual practice, however, this is not feasible. Due to the imperfections in the system geometry, the belt velocity vector is not normal to the roller axis of rotation and the belt will move laterally relating to the roller until reaching a kinematically stable position. Existing methods of controlling belt lateral movement comprise servo systems, crowned rollers and flanged rollers. In any control system, it is necessary to prevent high local stresses which may result in damage to the highly sensitive photoconductive belt. Active systems, such as servo systems employ steering rollers which apply less stress on the belt. However, active systems of this type are generally complex and costly.

Passive systems, such as flanged rollers, are less expensive, but generally produce high stresses. Various types of flanged rollers systems have hereinbefore been developed to improve the support and tracking of photoconductive belts. For example, the drive roller may have a pair of flanges secured to opposed ends hereof. If the photoconductive belt moves laterally, and engages one of the flanges, it must be capable of either sliding laterally with respect to the roller system, or locally deforming either itself or the roller system to maintain its position. The edge force required to shift the belt laterally or locally deform itself on the roller system usually greatly exceeds the maximum tolerable edge force. Thus, the belt would start to buckle resulting in failure of the system. Alternatively, the flanges may be mounted on one of the idler rollers rather than the drive roller. Lateral motion is controlled by bending the belt to change the approach angle to the drive roller. A system of this type may develop low edge force when compared to having the flanges mounted on the drive roller. However, the primary risk associated with this system is that performance depends significantly on the belt bending in its plane. Although the forces in this type of a system are often reduced, they still appear to be unacceptable in that they generally exceed the belt buckling force. Thus, the side edge of the photoconductive belt eventually buckles reducing the lift thereof.

Other belt steering systems include U.S. Pat. No. 4,198,155 which discloses a belt assembly in which a sub-belt has a photoconductive belt releasably secured to it. The sub-belt and the photoconductive belt move in unison with one another about a path defined by a drive roller, a steering post and a tension post. The sub-belt assembly is between the photoconductive belt and the drive assembly. In Soviet Union Patent No. 630,141, a belt conveyor drive is disclosed that includes a traction belt entrained around an end guide and a driving drum. One problem with this belt driving system is that the entrained traction belt is not freely rotatable and will therefore disturb the traction of the conveyor belt.

A belt tracking system that answers most of the above-mentioned drawbacks is disclosed in U.S. Pat. No. 4,657,370 which shows a stationary non-rotating arcuate belt tracking shoe defining a path around which a belt travels. When driving the belt with a drive roll around the tracking shoe, the velocity of the tracking shoe is zero when the belt touches an edge guide. However, the required belt drive torque is high and there is increased wear of the belt due to constant sliding of the belt over the skid shoe surface. A highly undesirable consequence is increased belt contamination and loss of driving capability. The coefficient of friction between the drive roll and the photoreceptor belt deteriorates and causes the belt to slip increasingly. This makes the motion of the belt non-uniform ("jerky"), which results in producing copy quality defects when the belt is moved forward in the copying mode. In addition, sometimes the belt is also required to move backwards, for example for dislodging paper fibers and other debris from under the blade of a blade cleaning system in a copier.

SUMMARY OF THE INVENTION

Accordingly, in accordance with the present invention, an improved skid plate based photoreceptor tracking system is disclosed that comprises a stationary non-rotating shoe or skid plate with a belt path defining surface for supporting a belt thereon, the tracking shoe including vertically orientated flanges at opposed sides of the path defining surface extending from the path defining surface outwardly to provide skid edge guides. Preferably the arcuate belt tracking shoe has in the process direction, a first substantially planar path defining surface, an arcuate path defining surface, and a second substantially planar path defining surface to enable the belt to be reversed in direction when being transported thereabout. A rotatably driven belt transport roll is included and an endless photoreceptor belt arranged to move in a predetermined path around the rotatably driven transport roll. A substantially unconstrained slip belt is introduced between the photoreceptor belt and skid plate in order to reduce the high drive torque heretofore necessary to drive the photoreceptor around the skid plate; minimize the abrasion of the back coating on the photoreceptor; minimize impact of the photoreceptor on the skid plate; reduce drive roll contamination; and maintain belt tracking, as the slip belt is allowed to move axially with the photoreceptor belt.

DESCRIPTION OF THE PREFERRED EMBODIMENT

The invention will now be described with reference to the preferred embodiment of the slip belt and belt tracking shoe in an electrostatographic apparatus employing same.

Figure 1:
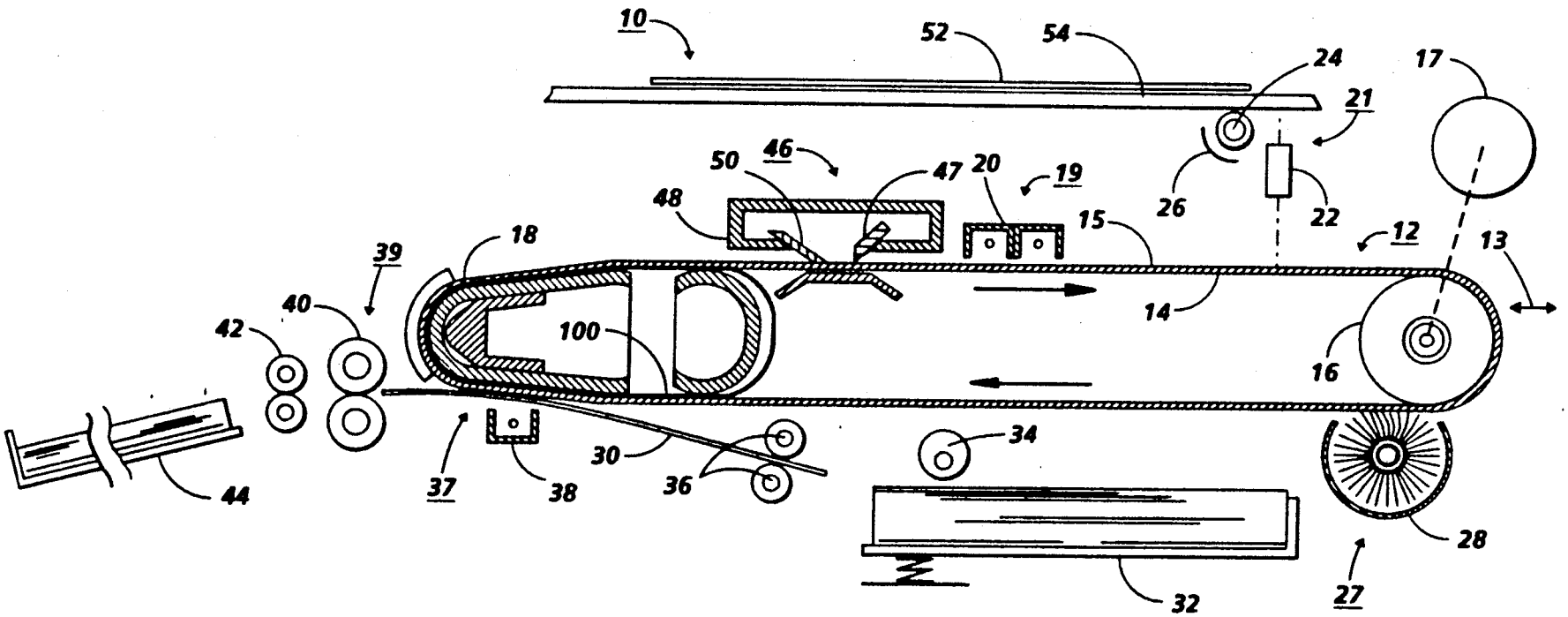
FIG. 1 is a schematic representation in cross section of an automatic electrostatographic reproducing machine with the slip belt tracking means according to the present invention included therein.

Referring now to FIG. 1, there is shown by way of example, an automatic electrostatographic reproducing machine 10 which includes a removable processing cartridge employing the slip belt and belt tracking shoe according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around belt tracking shoe 18 and travels in the direction indicated by the arrows on the inner run of the belt to bring the image bearing surface thereon past the plurality of xerographic processing stations. Suitable drive means such as motor 17 are provided to power and coordinate the motion the various cooperating machine components whereby a faithful reproduction of the original input scene information is recorded upon a sheet of final support material 30, such as paper or the like.

Initially, the belt 14 moves the photoconductive surface 15 through a charging station 19 wherein the belt is uniformly charged with an electrostatic charge placed on the photoconductive surface by charging corotron 20 in known manner preparatory to imaging. Thereafter the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image. The exposure station 21 may comprise a bundle of image transmitting fiber lenses 22 produced under the tradename of "SELFOC" by Nippon Sheet Glass Company Limited, together with an illuminating lamp 24 and a reflector 26. After exposure of the belt 14 the electrostatic latent image recorded on the photoconductive surface 15 is transported to development station 27, wherein developer is applied to the photoconductive surface 15 of the belt 14 rendering the latent image visible. Suitable development stations could include a magnetic brush development system including developer roll 28, utilizing a magnetizable developer mix having coarse magnetic carrier granules and toner colorant particles.

Sheets 30 of the final support material are supported in a stack arrangement on elevated stack support tray 32. With the stack at its elevated position, the sheet separator segmented feed roll 34, feeds individual sheets therefrom to the registration pinch roll pair 36. The sheet is then forwarded to the transfer station 37 in proper registration with the image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the belt tracking shoe 18, and the sheet containing the toner image thereon is advanced to fixing station 39 wherein roll fuser 40 fixes the transferred powder image thereto. After fusing the toner image to the copy sheet, the sheet 30 is advanced by output rolls 42 to sheet stacking tray 44.

Although a preponderance of toner powder is transferred to the final support material 30, invariably some residual toner remains on the photoconductive surface 15 after the transfer of the toner powder image to the final support material. The residual toner particles remaining on the photoconductive surface after the transfer operation is removed from the belt 14 by the cleaning station 46 which comprises a cleaning blade 47 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by cleaning brush as is well known in the art.

Normally, when the copier is operated in the conventional mode, the original document 52 to be reproduced is placed image side down upon a horizontal transport viewing platen 54 which transports the original past the exposure station 21. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

Figure 2:
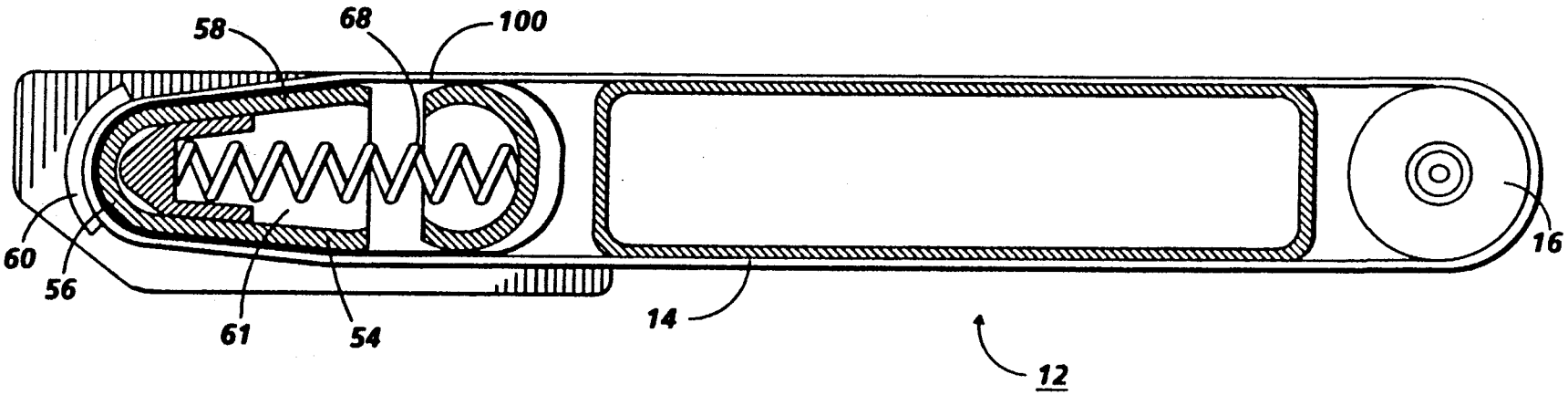
FIG. 2 is an enlarged view of the photoreceptor cartridge of FIG. 1 showing in cross section further details of the slip belt and tracking shoe.
Figure 3:
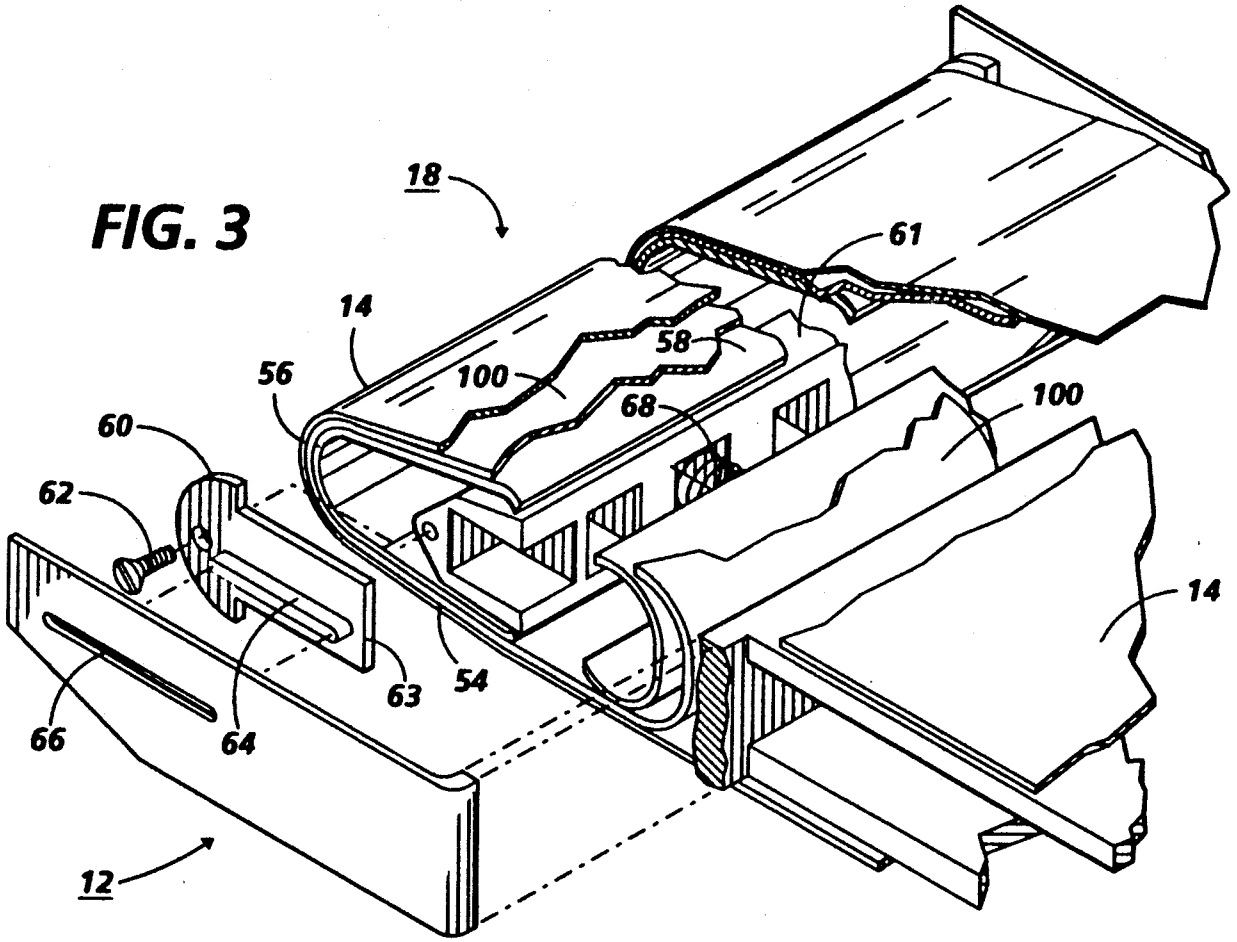
FIG. 3 is an exploded view of the belt tracking shoe.

The belt tracking shoe for controlling lateral movement of the belt will be described in greater detail with specific reference to FIGS. 2–4. With particular reference to FIG. 3, the belt tracking shoe 18 comprises a first substantially horizontal path defining surface 54, an arcuate path defining surface 56, and a second substantially planar path defining surface 58 which may or may not be substantially parallel to the planar surface 54 which path is being continuous to enable the belt to be reversed in direction by being transported therearound. It will be understood, of course, that only the arcuate path defining surface 56 is required for the belt tracking surface, the planar surfaces 54 and 58 providing support and ease of manufacture. The belt tracking surface itself should be relatively smooth and hard as well as having a relatively low coefficient of friction. Typically the coefficient of friction of the tracking surface is less than 0.3 and always less than that of the driving roll. Typically the belt tracking surfaces may be made from shaped sheet metal or molded directly from plastic. To provide a hard surface, the belt tracking shoes are preferably made from glass coated steel, PTFE Teflon impregnated anodized aluminum or lubricated polycarbonate. Belt tracking shoe is supported by support assembly 61 in the interior thereof which may be fastened to planar and arcuate surfaces by any suitable means such as screws, adhesive binding or snap fit. A single part can be injection molded using the above mentioned plastic which also includes the edge guides 60 to be hereinafter discussed. The planar and arcuate surfaces of the belt tracking shoe extend at least across the width of the belt to be transported therearound and include vertically oriented flange edge guide members 60 at opposed ends of the shoe forming edge guides for the belt when tracked around the shoe. Since the belt may walk in either axial (or lateral) direction depending on imperfections in the system geometry as previously discussed, these stationary edge guides are provided on both sides of the belt tracking shoe. The vertically oriented flange edge guide members 60 are supported by flange support 63 which is secured to the support assembly 61 by suitable means such as screws 62. The actual flange portion forming the edge guides takes the form of a crescent shaped flange as indicated by the segment terminated by lines A—A in FIG. 4. Both flange supports 63 are provided with slides 64 for mounting engagement with track 66 in the cartridge assembly 12 as shown in FIG. 3.

Figure 4:
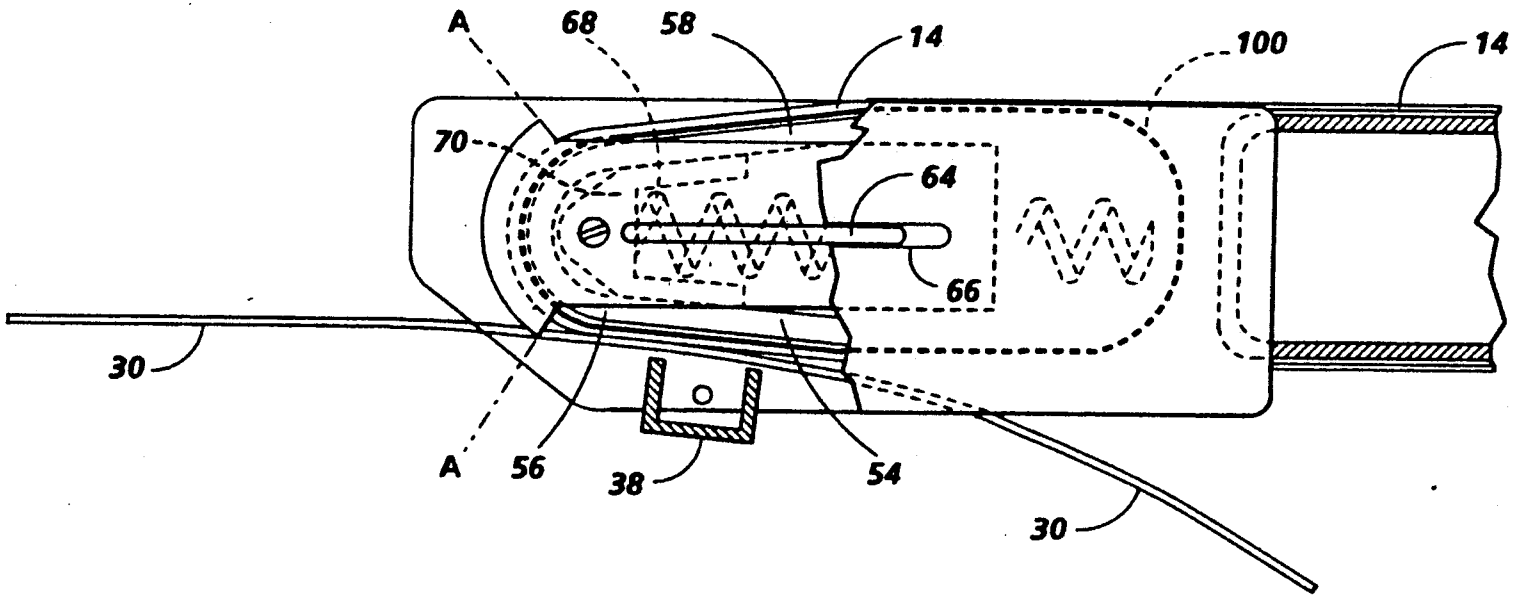
FIG. 4 is a further enlarged view of the belt tracking shoe in the cartridge showing the position of the transfer corotron relative to the platen portion and arcuate stripping of the copy sheet.

The belt tracking shoe is urged toward the left in FIG. 4 to apply belt tensioning force by means of springs 68 which is supported at the inboard and outboard ends by support member 70 in the cartridge frame. Also illustrated in FIG. 4 is a transfer corotron in opposed transferring relationship with the first planar portion 54 to enable transfer of the toner image on the belt 14 to a sheet of copy paper which may be transported therebetween. In this configuration of planar portion 54 serves as a transfer platen in the copying apparatus. Further illustrated in dotted line in FIG. 4 is a copy sheet 30 being driven through the transfer zone in transfer relationship with the toner image on the photoconductive belt and stripping by virtue of its beam strength at the beginning of the arcuate portion 56 of the belt tracking shoe.

In order to alleviate drawbacks associated with shoe 18 (FIG. 1), such as, the high drive torque that is required as a result of sliding friction between photoreceptor belt 14 and shoe 18, an intermediate slip belt 100 is positioned between the photoreceptor belt and the shoe which provides a partially rotating friction. Tests have shown that since the rotational friction is smaller than the sliding friction, a reduction in input torque results up to about 40%. Slip belt 100 is unconstrained so that photoreceptor belt 14 drives the slip belt freely since the coefficient of friction between the slip belt and photoreceptor belt is greater than the coefficient of friction between the slip belt and the shoe. In fact, the slip belt material is chosen such that it has a very low coefficient of friction between itself and the shoe. The slip belt is preferably made from PTFE Teflon with the wall thickness in inches of about 0.0025. A PTFE Teflon material thickness of 0.005 inches could also be used. Other slip belt materials include Nylon mesh of about 0.005 inches in thickness or Mylar skin of about 0.002 inches in thickness.

A further benefit of the slip belt 100 of the present invention is that wear of the anti-curl back coating on photoreceptor belt 14 that would result due to rubbing frictional contact between the photoreceptor belt and the shoe is eliminated because there is no relative motion between the photoreceptor belt and the shoe or slip belt and the slip belt surface provides a temporary reinforcement to the photoreceptor backing as the photoreceptor passes over the shoe. It should be understood that belt tracking is not disturbed by introducing slip belt 100 between photoreceptor belt 14 and shoe 18 since the slip belt is unconstrained and allowed to move axially with the photoreceptor belt. Also, drive roll contamination is reduced since the coefficient of friction between the slip belt and the shoe is minimal. Photoreceptor motion uniformity (forwards and backwards) is improved with the introduction of slip belt 100 into the belt tracking system.

The operation of the belt tracking shoe for controlling lateral movement of the photoreceptor belt incorporating slip belt 100 will be described with reference to FIG. 1. As the photoreceptor belt and slip belt move in unison over the stationary non-rotating belt tracking shoe, the friction force vector due to the photoreceptor belt and slip belt sliding on the tracking shoe acts in a direction parallel to the velocity vector of the belt motion. The major velocity component of the belts is in the direction they are driven around the belt tracking shoe and the major component of friction will be in that direction also. If and when the belts tend to move axially (or laterally) toward an edge guide, they will have a small component of velocity and resultant frictional force axially toward the edge guide. However, when the belts touch the edge guide, the velocity in the axial direction is zero. Therefore, the frictional force in the axial direction due to the belt tracking shoe on the photoreceptor and slip belts is or approaches zero. At this time the system geometry produces the only forces which need to be resisted by the edge guide and the belt tracking shoe provides no contribution to the edge force on the belts at the edge guide. This permits the force in the axial direction at the edge guide to be equal to the force imparted by the drive roll and as a result, the belts move axially upon the drive roll to maintain their position with respect to the edge guide. In other words, an equilibrium is reached between the reaction forces at the edge guide and the walk inducing forces exerted on the belts by the system. In a typical photoreceptor belt the maximum edge force which can be tolerated without edge damage or buckling is of the order of 1.5 pounds.

It should now be understood that an improved photoreceptor belt tracking system has been disclosed that introduces a seamless, smooth, low coefficient of friction slip belt in between a shoe and a photoreceptor. The slip belt works like a lubricating film, as well as, like a protective layer for the anti-curl back coating on the photoreceptor. The slip belt is unconstrained so that belt traction of the photoreceptor is unaffected.

The disclosures of the patents referred to herein are hereby specifically and totally incorporated herein by reference.

While the invention has been described with reference to specific embodiments it will be apparent to those skilled in the art, that many alternatives, modifications and variations may be made. For example, while the belt tracking system has been described with reference to a photoreceptor belt, it will be understood that it may be used in other environments. Accordingly it is intended to embrace all such alternatives, modifications as may fall within the spirit and scope of the appended claims.

We claim:

1. An apparatus for supporting a belt arranged to move in an endless predetermined path and for controlling the lateral movement of the belt from the predetermined path, said apparatus comprising: a stationary non-rotating arcuate tracking shoe with a belt path defining surface for supporting a belt thereon, said tracking shoe including vertically oriented flanges at opposed sides of said path defining surface and extending from said path defining surface outwardly to provide belt edge guides; and a continuously non-driving, substantially unconstrained, freely rotatable slip belt adapted to be positioned between said tracking shoe and a belt entrained around said tracking shoe, said slip belt being freely rotatable and slipping against said tracking shoe at all times, and wherein said slip belt is driven by the belt entrained around said tracking shoe without relative motion between the belt and said slip belt.

2. Apparatus for transporting and tracking a belt arranged to move in an endless predetermined path and for controlling lateral movement of the belt from the predetermined path, comprising: at least one rotatably driven belt transport roll; a belt tracking means; an endless belt arranged to move in a predetermined path around said at least one rotatably driven transport roll and said tracking means, said tracking means comprising a stationary non-rotatable arcuate tracking shoe with a belt defining surface for supporting a belt thereon and including vertically oriented flanges at opposed sides of said path defining surface and extending from said path defining surface outwardly to provide belt edge guides; and slip belt means for positioning between said endless belt and said belt tracking means and adapted to continuously slip against said tracking means and simultaneously maintain non-relative motion with said endless belt by frictional contact in order to reduce the input torque required to drive said transport roll while simultaneously minimizing wear of the inside surface of said endless belt with respect to said tracking means.

3. The apparatus of claim 2, wherein said slip belt is seamless and has a circumference that is less than said endless belt.

4. The apparatus of claim 3, wherein the coefficient of friction between said slip belt and said endless belt is greater than that between said slip belt and said tracking means.

5. The apparatus of claim 4, wherein said slip belt is made of Teflon PTFE and having a thickness of about 0.0025 inches.

6. Electrostatographic printing apparatus of the type having an endless photoconductive belt arranged to move in a predetermined path past a plurality of processing stations, said apparatus including means to transport said photoconductive belt and control lateral movement of said photoconductive belt from said predetermined path including at least one rotatably driven belt transport roll; a belt tracking means; an endless belt arranged to move in a predetermined path around said at least one rotatably driven transport roll and said tracking means, said tracking means comprising a stationary non-rotatable arcuate tracking shoe with a belt defining surface for supporting a belt thereon and including vertically oriented flanges at opposed sides of said path defining surface and extending from said path defining surface outwardly to provide belt edge guides for supporting a belt thereon; and a continuously slipping, non-driving, substantially unconstrained, freely rotatable slip belt adapted to be loosely positioned between said tracking shoe and a belt entrained around the belt defining surface of said tracking shoe, said slip belt being continuously slipping with respect to said belt defining surface thereof during rotation of said transport roll.

7. The apparatus of claim 6, wherein said slip belt is seamless.

8. In an apparatus for supporting a belt arranged to move in an endless predetermined path and for controlling the lateral movement of the belt from the predetermined path that includes a stationary non-rotating arcuate tracking shoe with a belt path defining surface for supporting a belt thereon, said tracking shoe including vertically oriented flanges at opposed sides of said path defining surface and extending from said path defining surface outwardly to provide belt edge guides, the improvement for reducing the drive torque necessary to drive a belt around the tracking shoe characterized by a continuously non-driving, substantially unconstrained, freely rotatable slip belt adapted to be loosely positioned between said tracking shoe and a belt entrained around said tracking shoe, said slip belt being adapted to continuously slip against an adjacent surface of said tracking shoe while simultaneously maintaining non-relative motion with the belt.

9. In an electrostatographic printing apparatus of the type having an endless photoconductive belt arranged to move in a predetermined path past a plurality of processing stations, said apparatus including means to transport said photoconductive belt and control lateral movement of said photoconductive belt from said predetermined path including at least one rotatably driven belt transport roll adapted for driving connection only with said photoconductive belt; a belt tracking means; an endless belt arranged to move in a predetermined path around said at least one rotatably driven transport roll and said tracking means, said tracking means comprising a stationary non-rotatable arcuate tracking shoe with a belt defining surface for supporting a belt thereon and including vertically oriented flanges at opposed sides of said path defining surface extending from said path defining surface outwardly to provide belt edge guides, the improvement for reducing the torque required to drive said transport roll and reduce wear on the inside surface of the endless belt, characterized by a continuously non-driving, substantially unconstrained, freely rotatable slip belt adapted to be positioned between said tracking shoe and a belt entrained around the belt defining surface of said tracking shoe, said slip belt being continuously slipping with respect to said belt defining surface thereof during rotation of said transport roll.

10. The improvement of claim 9, wherein said slip belt is seamless and has less of a circumference than the endless belt, but substantially more of a circumference than said tracking means so that it has a portion thereof loosely fitting around said tracking means.

11. Apparatus for transporting and tracking a belt arranged to move in an endless predetermined path and for controlling lateral movement of the belt from the predetermined path, comprising: at least one rotatably driven belt transport driving roll; a belt tracking means; an endless belt arranged to move in a predetermined path around said at least one rotatably driven transport driving roll and said tracking means, said tracking means comprising a stationary non-rotatable arcuate tracking shoe with a belt defining surface for supporting a belt thereon and including vertically oriented flanges at opposed sides of said path defining surface and extending from said path defining surface outwardly to provide belt edge guides; and a continuously non-driving, substantially unconstrained, freely rotatable slip belt means for positioning between said endless belt and said belt tracking means in order to reduce the input torque required to drive said transport roll while simultaneously minimizing wear of the inside surface of said endless belt with respect to said tracking means, said slip belt means being adapted to continuously slip with respect to said belt defining surface of said tracking means during rotation of said transport driving roll.

* * * * *